US009051942B2

(12) United States Patent
Su

(10) Patent No.: US 9,051,942 B2
(45) Date of Patent: Jun. 9, 2015

(54) FAN WITH FLUID DIVERSION MECHANISM

(71) Applicant: Yen-Wen Su, Taoyuan County (TW)

(72) Inventor: Yen-Wen Su, Taoyuan County (TW)

(73) Assignee: ENERMAX TECHNOLOGY CORPORATION, Taoyuan County (TW)

( * ) Notice: Subject to any disclaimer, the term of this patent is extended or adjusted under 35 U.S.C. 154(b) by 385 days.

(21) Appl. No.: 13/661,020

(22) Filed: Oct. 25, 2012

(65) Prior Publication Data

US 2013/0156571 A1 Jun. 20, 2013

(30) Foreign Application Priority Data

Nov. 15, 2011 (TW) ..... 100221561 U

(51) Int. Cl.
*F04D 29/54* (2006.01)
*F04D 25/06* (2006.01)

(52) U.S. Cl.
CPC ..... *F04D 29/547* (2013.01); *F04D 25/0613* (2013.01)

(58) Field of Classification Search
CPC .... F04D 29/526; F04D 29/545; F04D 29/547
USPC ..... 415/220
See application file for complete search history.

(56) References Cited

U.S. PATENT DOCUMENTS

2003/0202879 A1* 10/2003 Huang et al. ..... 415/220
2008/0310952 A1* 12/2008 Lin ..... 415/121.2

FOREIGN PATENT DOCUMENTS

TW M287881 U 2/2006

* cited by examiner

*Primary Examiner* — Richard Edgar
(74) *Attorney, Agent, or Firm* — Chun-Ming Shih; HDLS IPR Services

(57) ABSTRACT

A fan with a fluid diversion mechanism includes a fan frame structure and a vane wheel, and the fan frame structure has a containing space, an air inlet and an air outlet, and the fan frame structure includes a coaming plate having a plurality of diversion components, and an opening formed at any one of the diversion components and arranged in a direction towards the air inlet, and the vane wheel is installed in the containing space of the fan frame structure, so that when the vane wheel is operated, air current produced by vanes of the fan guides the air current entered from the diversion component to an external side of a retaining platform which is a leeward side, and the air current has an effective coverage for blowing a desired heat source and improves the overall airflow and air pressure of the fan.

11 Claims, 10 Drawing Sheets

FAN WITH FLUID DIVERSION MECHANISM

This application is based on and claims the benefit of Taiwan Application No. 100221561 filed Nov. 15, 2011 the entire disclosure of which is incorporated by reference herein.

FIELD OF THE INVENTION

The present invention relates to a heat dissipating fan, in particular to the fan with a fluid diversion mechanism that is applied to a heat source of an electronic device.

BACKGROUND OF THE INVENTION

In recent years, integrated circuits of electronic devices become increasingly smaller, and the computing speed becomes increasing greater, and thus high temperature will be produced from the high performance of the electronic device such as a central processing unit (CPU), and the high temperature will retard the computing speed of the CPU or even cause a system down of a computer. To overcome this problem, a heat dissipating fan is generally installed to the CPU of the computer to enhance the heat dissipation capability. However, a motor is installed at the center of the heat dissipating fan, and the bottom area of the motor is superimposed onto the CPU chip, so that the air-blowing efficiency at the operating area of the center position will give rise of an leeward issue and the expected heat dissipation effect cannot be achieved, or the overheated CPU with a high temperature will cause a system down of the computer.

As disclosed in Taiwan Utility Model No. M287881, a heat dissipating fan comprises a plurality of diversion members, and at least one rib coupled between the diversion members, wherein the diversion member is extended in a curved direction and disposed in a non-concentric circular shape to define an opening, and a fan vane wheel with a plurality of vanes is installed, and the distance from an end of each vane to each diversion member is not consistent, so as to reduce the secondary flow phenomenon occurred between the vane and the diversion member. Although the heat dissipation effect can be improved by increasing the air input by the intervals, another problem of wind shear sound will be resulted easily by the wind resistance. In other words, the air pressure cannot be increased effectively, and noises will be produced. Obviously, the conventional heat dissipating fan requires feasible solutions and improvements.

SUMMARY OF THE INVENTION

Therefore, it is a primary objective of the present invention to provide a fan with a fluid diversion mechanism comprising a coamimg plate with a diversion component and a vane wheel to improve the airflow of the heat dissipating fan and reduce the back pressure of the heat dissipating fan.

To achieve the aforementioned objective, the present invention provides a fan with a fluid diversion mechanism, comprising a fan frame structure and a vane wheel, wherein the fan frame structure has a containing space provided for installing the vane wheel, and an air inlet and an air outlet formed at the fan frame structure, and the fan frame structure includes a coaming plate having a plurality of diversion components and an opening formed at each of the diversion components and arranged in a direction towards the air inlet.

The present invention further has the following effect. With the plurality of diversion components installed on the coaming plate of the fan frame structure, internal turbulence, backflow and noise produced by the operation of the vane wheel can be reduced effectively.

DESCRIPTION OF THE PREFERRED EMBODIMENTS

The technical contents of the present invention will become apparent with the detailed description of preferred embodiments accompanied with the illustration of related drawings as follows.

With reference to FIGS. 1 to 4, the present invention provides a fan with a fluid diversion mechanism for dissipating the heat of a heat source 3, and the fan comprises a fan frame structure 1 and a vane wheel 2.

Figure 1:
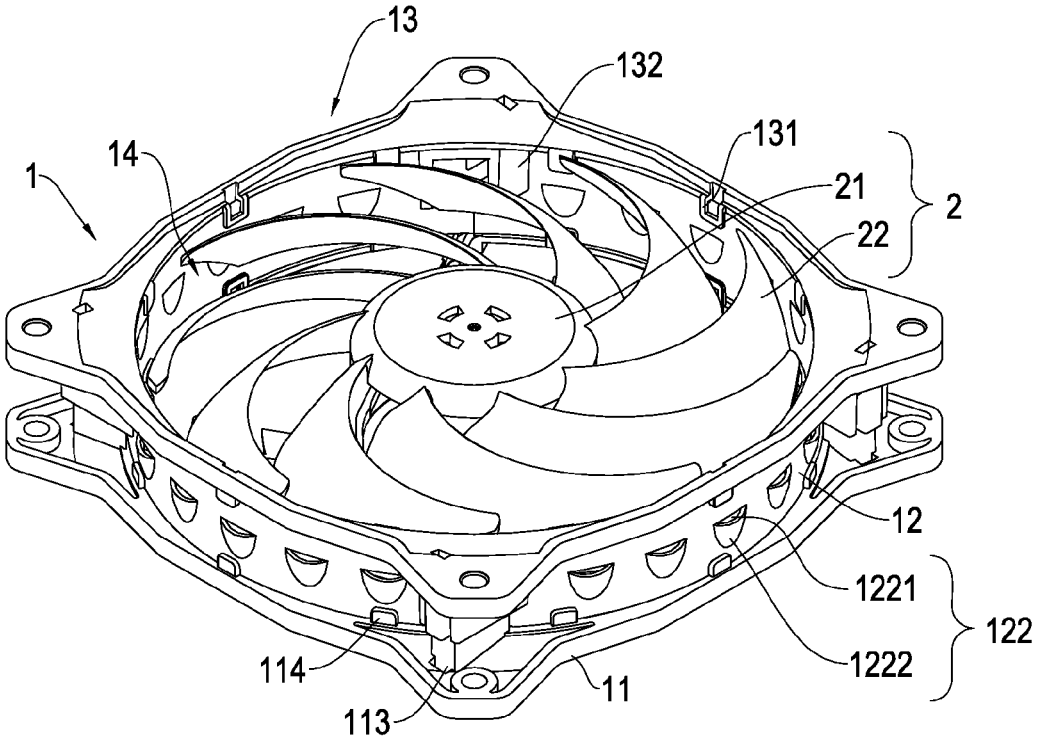
FIG. 1 is a perspective view of a first preferred embodiment of the present invention.
Figure 2:
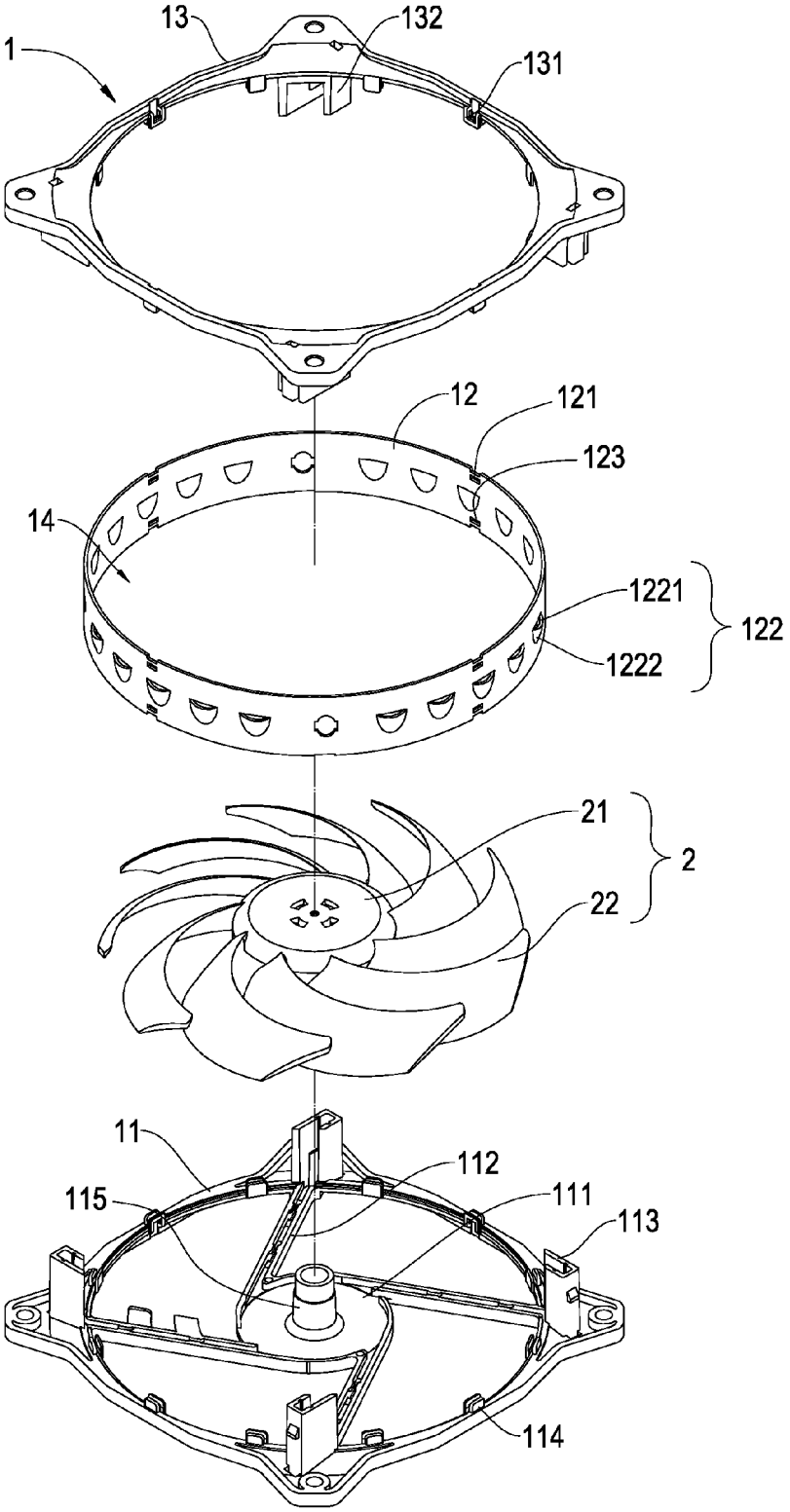
FIG. 2 is an exploded view of the first preferred embodiment of the present invention.
Figure 3:
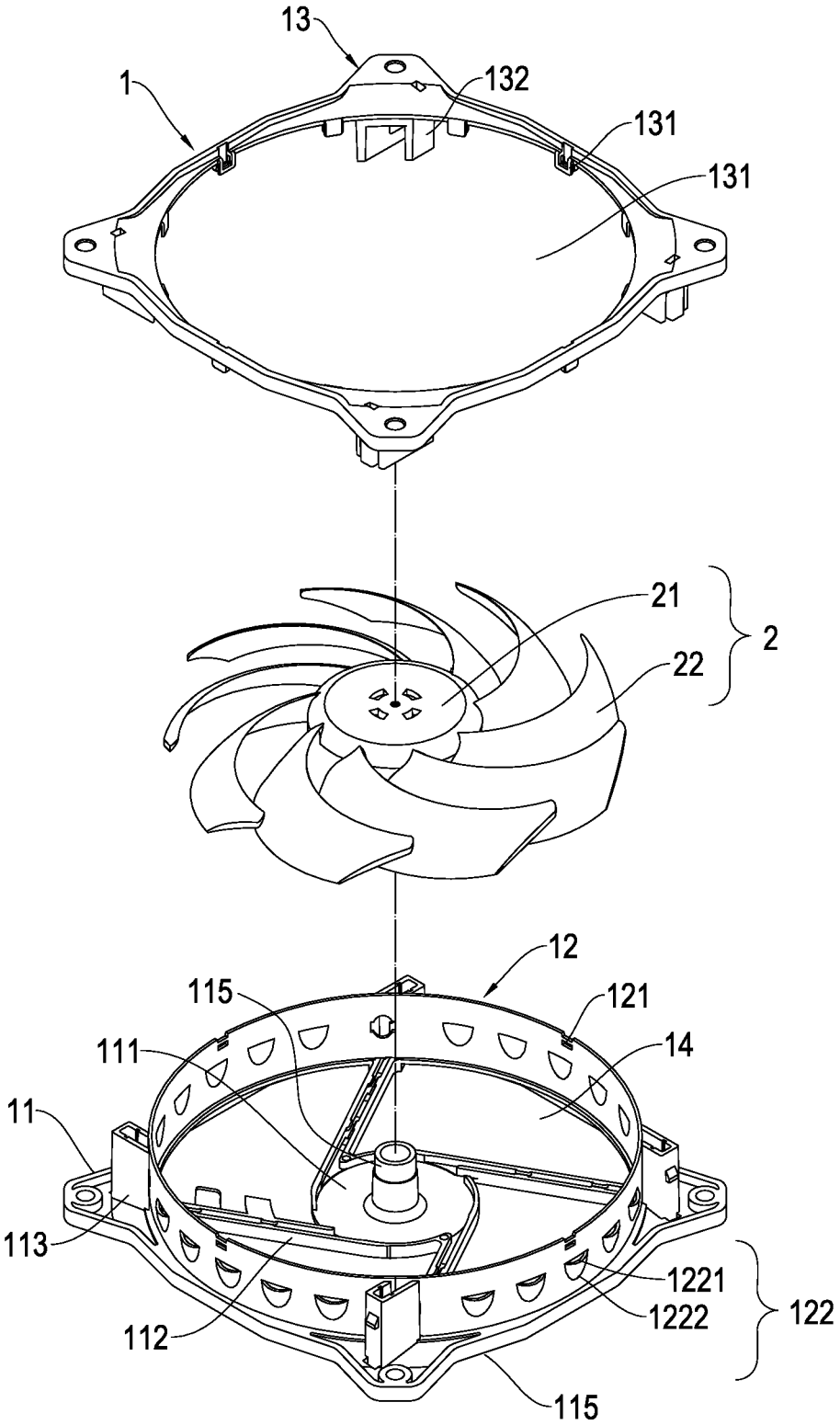
FIG. 3 is a perspective view of a base and a coaming plate of the present invention.
Figure 4:
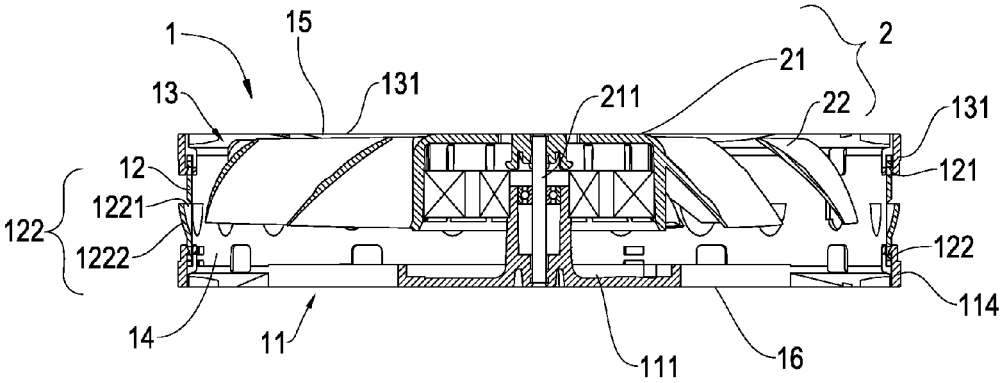
FIG. 4 is a cross-sectional view of the first preferred embodiment of the present invention.

The fan frame structure 1 has a containing space 14 provided for installing the vane wheel 2, and an air inlet 15 and an air outlet 16 formed at the fan frame structure 1 (as shown in FIG. 4), and the fan frame structure 1 of this preferred embodiment includes a base 11, a coaming plate 12 and a cover 13, and the cover 13 is coupled to the base 11 through the coaming plate 12. The fan frame structure 1 is made of plastic or metal.

The base 11 includes a retaining platform 111, a plurality of ribs 112, a plurality of connecting columns 113, a plurality of snap hooks 114 and a hollow column 115, wherein the retaining platform 111 is coupled to an outer frame through each rib 112 and disposed at the center position of the base 11; the retaining platform 111 is provided for placing an electric motor part, and the hollow column 115 is extended upwardly from the center position of the retaining platform 111. In addition, each connecting column 113 is formed separately at the four corners of the base 11, and each snap hook 114 is disposed between any two adjacent connecting columns 113.

The cover 13 includes a plurality of snap hooks 131 and a plurality of sheath columns 132, and each sheath column 132 is disposed separately at four corners of the cover 13, and each snap hook 131 is disposed between any two sheath columns 132. Each sheath column 132 is coupled and combined to each of the connecting columns 113 respectively.

In this preferred embodiment, the coaming plate 12 is a circular thin plate having a containing space 14 formed therein, and a plurality of upper snap slots 121 and a plurality of lower snap slots 123 formed in upper and lower edge areas of the coaming plate 12 respectively, and each upper snap slot 121 is provided for snapping and coupling each snap hook 131 of the cover 13, and each lower snap slot 123 is provided for snapping and coupling each snap hook 114 of the base 11. In addition, the coaming plate 12 has a plurality of diversion components 122 installed at a middle area of the coaming plate 12, and each diversion component 122 includes a convex arc plate 1222 extended from the exterior of the coaming plate 12 and an opening 1221 formed at a top area of the convex arc plate 1222 and arranged in a direction towards the air inlet 15. Each convex arc plate 1222 has a cross-sectional shape substantially in a semi-funnel shape. In addition, an inverted bevel 1223 is formed on an inner side of the coaming plate 12 at the periphery of each opening 1221 for guiding air to flow into each opening 1221 easily.

In this preferred embodiment, the vane wheel 2 can be made of plastic or metal, and the vane wheel 2 is an axial flow vane wheel comprising a hub 21 and a plurality of vanes 22, wherein each vane 22 is extended radially and outwardly from the center of the hub 21 and the hub 21 is installed at a position corresponding to the hollow column 115, so that the vane wheel 2 can be installed into the containing space 14 of the fan frame structure 1.

Figure 5:
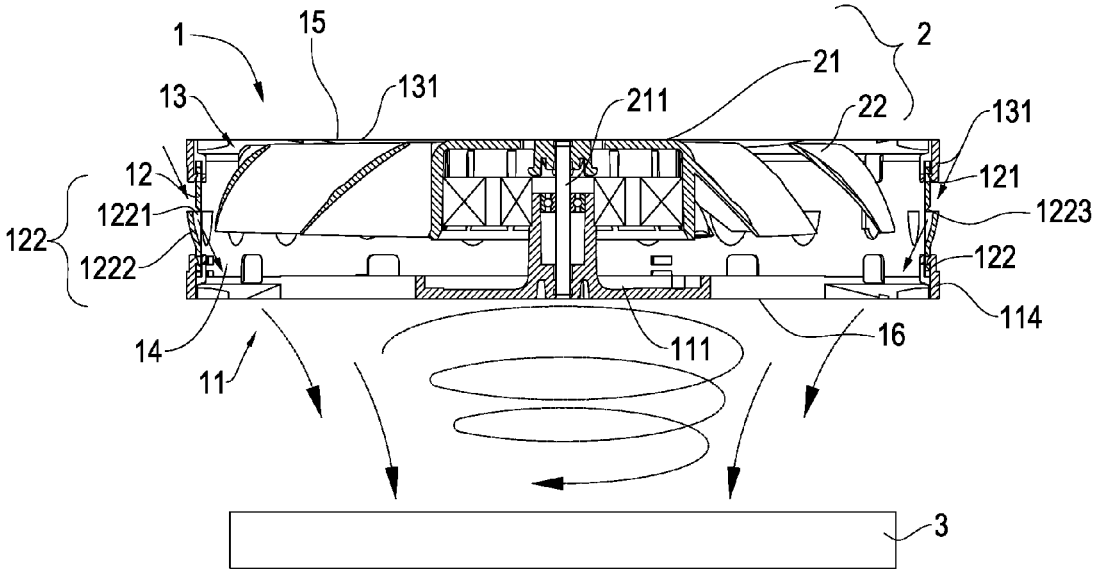
FIG. 5 is a schematic view of a fan applied to a heat source in accordance with the present invention.
Figure 6:
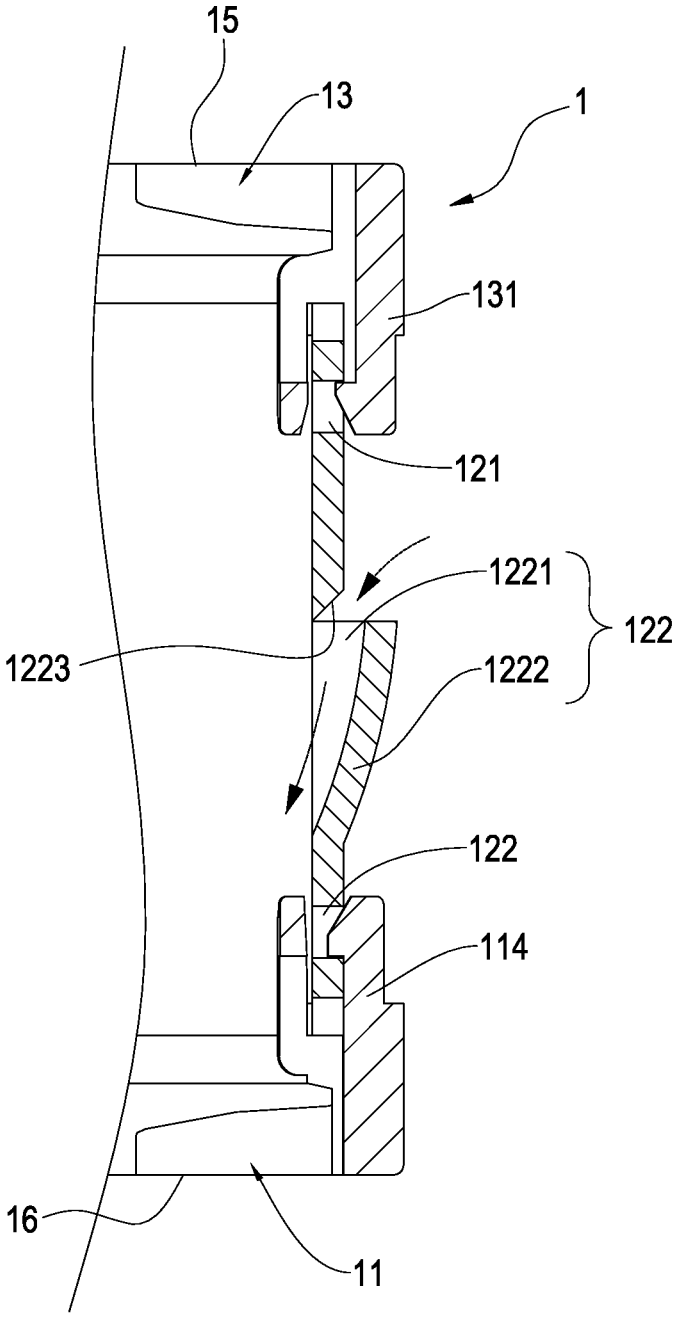
FIG. 6 is a partial blow-up view of FIG. 5.

With reference to FIGS. 5 and 6, the fan of the present invention is installed above a heat source 3, and an electric motor (not labeled in the figure) is provided for driving the vane wheel 2 to rotate, so as to drive surrounding air to enter from the air inlet 15 into the containing space 14 and discharge the air from the air outlet 16. The air around the external periphery of the coaming plate 12 is guided to enter from each opening 1221 of each diversion component 122 into the containing space 14 to improve the input and output airflows.

According to Bernoulli's Theory, flow velocity is inversely proportional to pressure. In a fluid (which is air or any other cooling gas used in a preferred embodiment of the present invention), a fluid (referring to the air driven by the vane wheel 2) with a faster flow velocity produces a negative air pressure due to a lower fluid density and a smaller pressure than that of the fluid with a slower flow velocity. As a result, a suction force is produced to suck the slower fluid (which is the air or cooling gas at the external side of the coaming plate 12) to the faster fluid to offset the pressure difference. Therefore, the present invention increases the pressure of the output air and uniformly pushing out an air current from the air outlet 16 to improve the overall heat dissipation efficiency and reduce noises. In addition, the direction arrangement of each opening 1221 of each diversion component 122 can reduce the backflow and turbulence of the air current.

Figure 7:
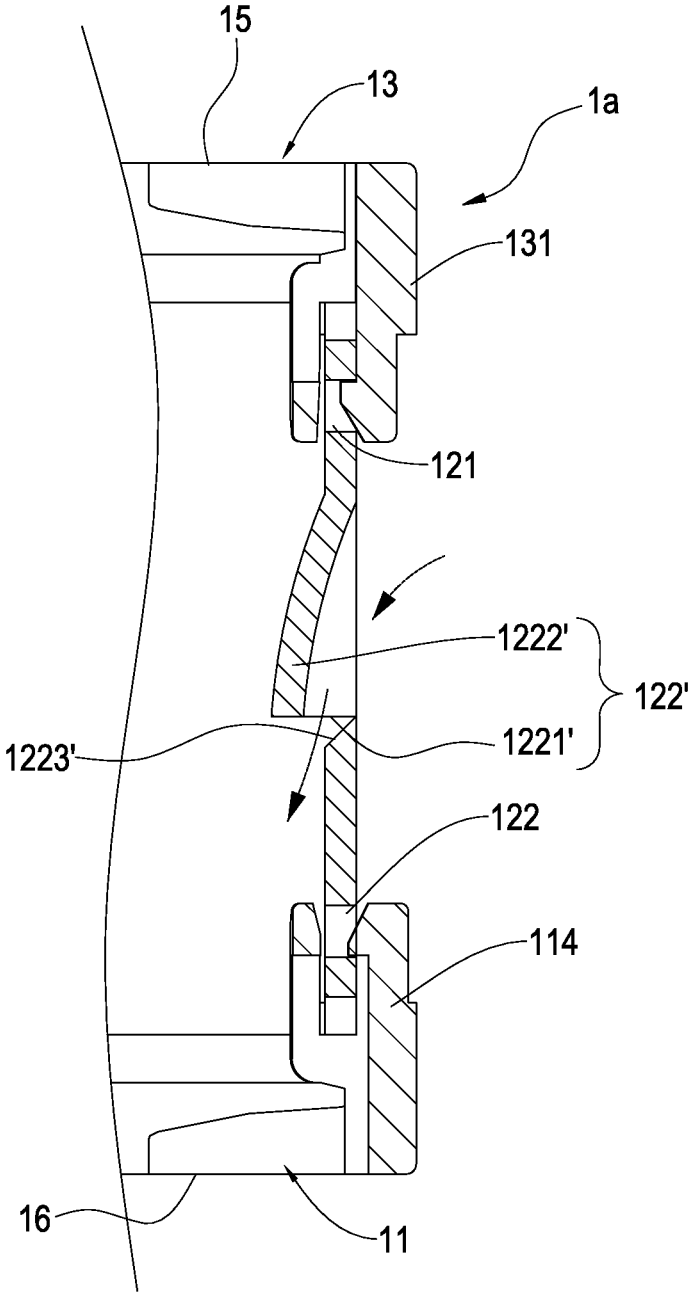
FIG. 7 is a partial blow-up cross-sectional view of a second preferred embodiment of the present invention.

With reference to FIG. 7 for a fan in accordance with the second preferred embodiment of the present invention, the difference between this preferred embodiment and the first preferred embodiment resides on that each diversion component 122' of the fan frame structure 1*a* of this preferred embodiment includes a concave arc plate 1222' concavely recessed into the coaming plate 12 and an opening 1221' formed at a bottom area of the concave arc plate 1222'. Each opening 1221' is arranged in a direction towards the air inlet 15. Each concave arc plate 1222' has a cross-sectional shape substantially in a semi-funnel shape. In addition, each opening 1221' has an inverted bevel 1223' formed at an inner side of the periphery of the coaming plate 12 for guiding air to flow into each opening 1221' easily.

Figure 8:
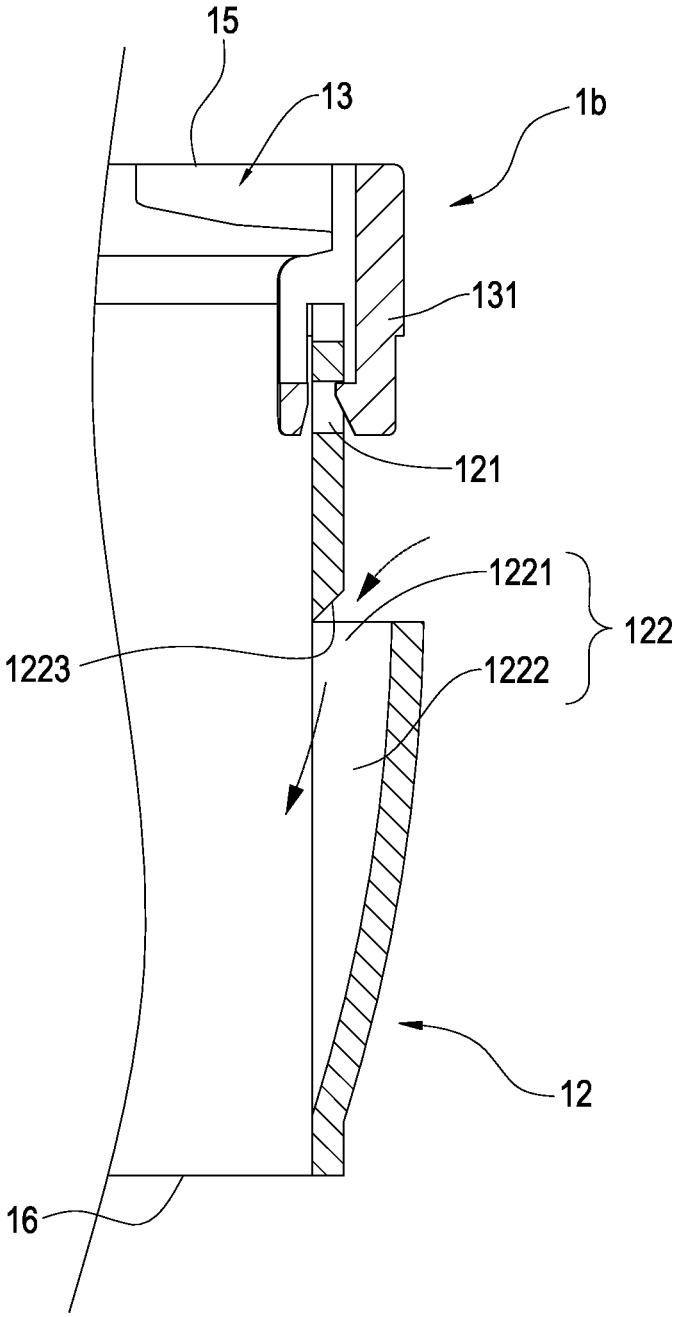
FIG. 8 is a partial blow-up cross-sectional view of a third preferred embodiment of the present invention.

With reference to FIG. 8 for a fan in accordance with the third preferred embodiment of the present invention, the difference between this preferred embodiment and the previous preferred embodiments resides on that the fan frame structure lb of this preferred embodiment includes a coaming plate 12 and a cover 13, wherein each upper snap slot 121 formed at the coaming plate 12 and each snap hook 131 formed at the cover 13 are used for snapping and connection. Each diversion component 122 includes a convex arc plate 1222 extended from the exterior of the coaming plate 12 and an opening 1221 formed at a top area of the convex arc plate 1222 and arranged in a direction towards the air inlet 15. Each opening 1221 has an inverted bevel 1223 formed on an inner side of the periphery of the coaming plate 12.

Figure 9:
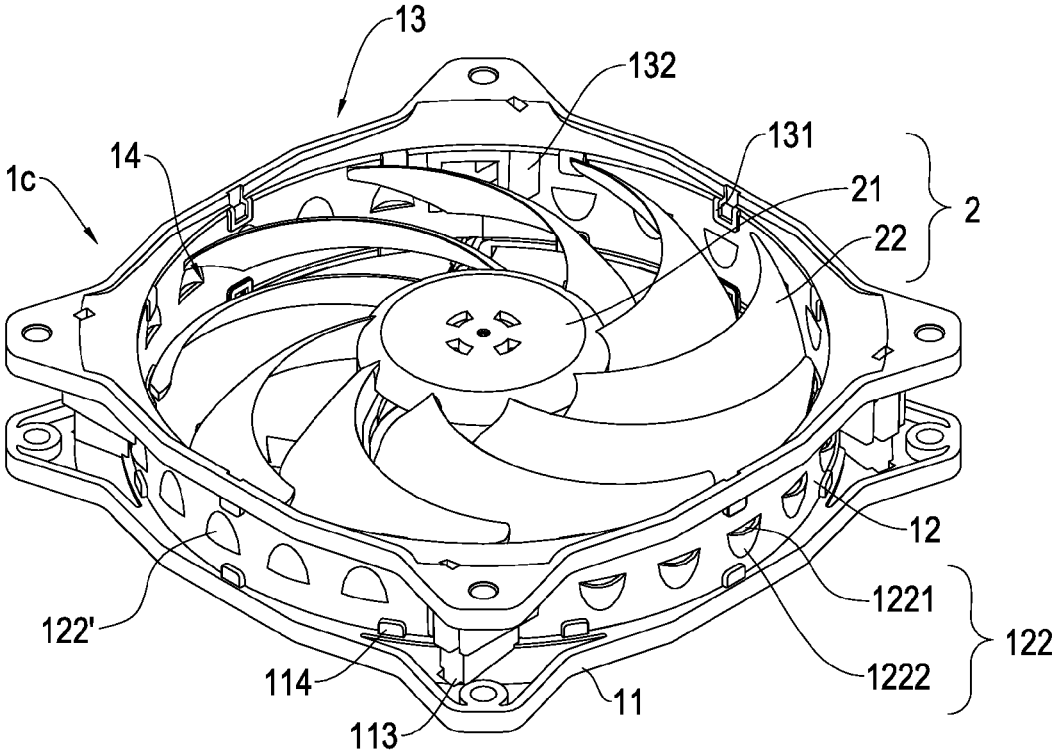
FIG. 9 is a perspective view of a fourth preferred embodiment of the present invention.

With reference to FIG. 9 for a fan in accordance with the fourth preferred embodiment of the present invention, the difference between this preferred embodiment and the previous preferred embodiments resides on that the fan frame structure 1*c* of this preferred embodiment has diversion components 122, 122' of different types installed on different sides of the coaming plate 12 respectively, wherein a portion of the diversion components 122 includes a convex arc plate 1222 extended from the exterior of the coaming plate 12 and an opening 1221 formed at the top area of the convex arc plate 1222, and the other portion of the diversion components 122' includes a concave arc plate 1222' concavely recessed into the coaming plate 12 and an opening 1221' formed at the bottom area of the concave arc plate 1222'.

Figure 10:
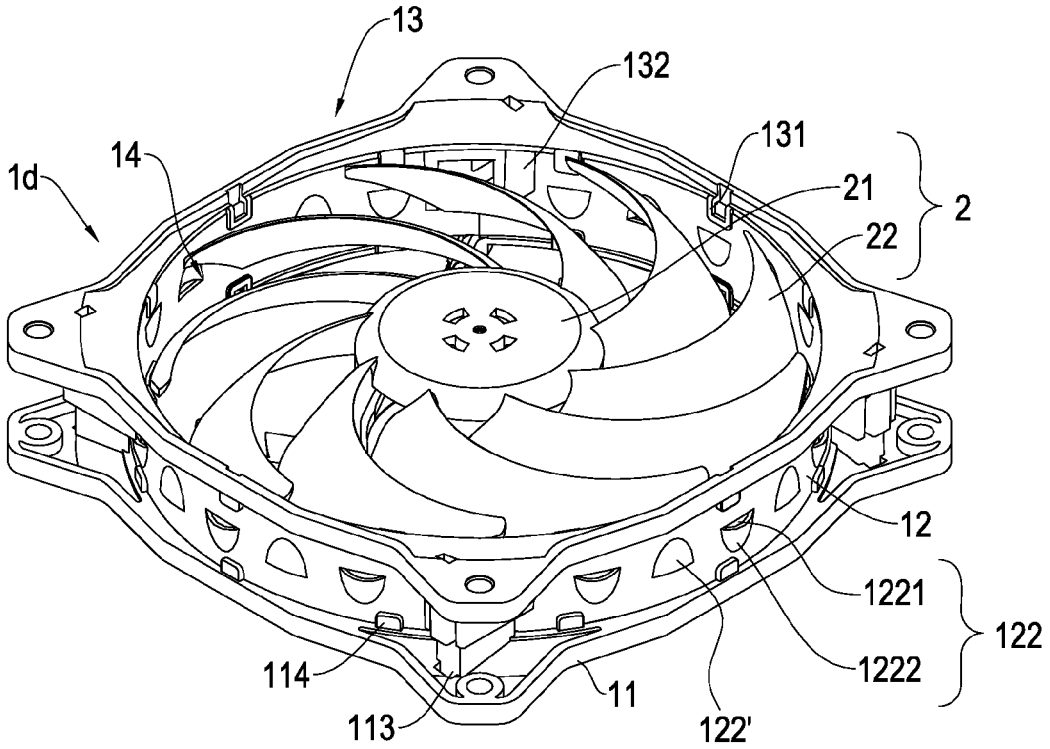
FIG. 10 is a perspective view of a fifth preferred embodiment of the present invention.

With reference to FIG. 10 for a fan in accordance with the fifth preferred embodiment of the present invention, the difference between this preferred embodiment and the previous preferred embodiments resides on that the fan frame structure 1*d* of this preferred embodiment has diversion components 122, 122' of different types installed on the coaming plate 12, and the diversion component 122 are disposed between any two diversion components 122', and each diversion component 122, 122' has a structure substantially the same as those described above, and thus will not be repeated.

The fan with a fluid diversion mechanism in accordance with the present invention further has the following advantages: 1. The invention can reduce the range of the leeward area effectively. 2. The invention can reduce backflow and turbulence. 3. The invention can increase the air pressure of the air outlet. 4. The invention can reduce the noise produced during the operation of the vane wheel. 5. The invention can fully utilize the air current produced by the heat dissipating fan.

In summation of the description above, the present invention achieves the expected objectives and overcomes the drawbacks of the prior art as well as complying with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. A fan with a fluid diversion mechanism, comprising:

a vane wheel; and a fan frame structure, having a containing space provided for installing the vane wheel, and an air inlet and an air outlet formed at the fan frame structure, and the fan frame structure including a coaming plate, and the coaming plate having a plurality of diversion components, and each of the diversion components having an opening arranged in a direction towards the air inlet, wherein any one of the diversion components includes a convex arc plate extended from an exterior of the coaming plate, and the opening is formed at a top area of the convex arc plate.

2. The fan with a fluid diversion mechanism according to claim 1, wherein the convex arc plate has a cross-section in a semi-funnel shape.

3. The fan with a fluid diversion mechanism according to claim 2, wherein the opening has an inverted bevel formed at the periphery of the opening.

4. The fan with a fluid diversion mechanism according to claim 1, wherein the fan frame structure further includes a base and a cover, and the base is coupled to the cover through the coaming plate, and the air outlet is formed at the base, and the air inlet is formed at the cover.

5. The fan with a fluid diversion mechanism according to claim 4, wherein the base includes a plurality of snap hooks, and the coaming plate has a plurality of lower snap slots coupled to the lower snap slots respectively.

6. The fan with a fluid diversion mechanism according to claim 4, wherein the cover includes a plurality of snap hooks, and the coaming plate has a plurality of upper snap slots coupled to the upper snap slots respectively.

7. The fan with a fluid diversion mechanism according to claim 1, wherein the fan frame structure further includes a cover coupled to the coaming plate, and the air outlet is formed at the coaming plate, and the air inlet is formed at the cover.

8. A fan with a fluid diversion mechanism, comprising:

a vane wheel; and a fan frame structure, having a containing space provided for installing the vane wheel, and an air inlet and an air outlet formed at the fan frame structure, and the fan frame structure including a coaminq plate, and the coaminq plate having a plurality of diversion components, and each of the diversion components having an opening arranged in a direction towards the air inlet, wherein any one of the diversion components includes a concave arc plate concavely recessed into the coaming plate, and the opening is formed at a bottom area of the concave arc plate.

9. The fan with a fluid diversion mechanism according to claim 8, wherein the concave arc plate has a cross-section in a semi-funnel shape.

10. The fan with a fluid diversion mechanism according to claim 9, wherein the opening has an inverted bevel formed at the periphery of the opening.

11. A fan with a fluid diversion mechanism, comprising:

a vane wheel; and a fan frame structure, having a containing space provided for installing the vane wheel, and an air inlet and an air outlet formed at the fan frame structure, and the fan frame structure including a coaming plate, and the coaming plate having a plurality of diversion components, and each of the diversion components having an opening arranged in a direction towards the air inlet, wherein a portion of the diversion components includes a convex arc plate extended from the exterior of the coaming plate, and the opening is formed at a top area of the convex arc plate, and the other portion of the diversion components includes a concave arc plate concavely recessed into the coaming plate, and the opening is formed at a bottom area of the concave arc plate.

* * * * *